US008141658B2

(12) United States Patent
Blair et al.

(10) Patent No.: US 8,141,658 B2
(45) Date of Patent: Mar. 27, 2012

(54) TILTED DRIVE SUB

(75) Inventors: Paris E. Blair, Casper, WY (US); Joseph L. Ficken, Casper, WY (US)

(73) Assignee: Hunting Energy Services, Inc., Houston, TX (US)

( * ) Notice: Subject to any disclaimer, the term of this patent is extended or adjusted under 35 U.S.C. 154(b) by 288 days.

(21) Appl. No.: 12/506,634

(22) Filed: Jul. 21, 2009

(65) Prior Publication Data

US 2010/0018773 A1 Jan. 28, 2010

Related U.S. Application Data

(60) Provisional application No. 61/082,665, filed on Jul. 22, 2008.

(51) Int. Cl.
*E21B 7/04* (2006.01)
*E21B 7/08* (2006.01)

(52) U.S. Cl. ..... 175/61; 175/73

(58) Field of Classification Search ..... 175/61, 175/73, 74, 76, 91, 376
See application file for complete search history.

(56) References Cited

U.S. PATENT DOCUMENTS

| | | | | |
|---|---|---|---|---|
| 2,709,574 | A * | 5/1955 | Arutunoff | 175/101 |
| 3,519,090 | A * | 7/1970 | Herring | 175/320 |
| 4,077,657 | A | 3/1978 | Trzeciak | 285/184 |
| 4,694,914 | A | 9/1987 | Obrecht | 175/61 |
| 4,813,497 | A | 3/1989 | Wenzel | 175/74 |
| 5,269,385 | A | 12/1993 | Sihlis | 175/74 |
| 5,343,966 | A | 9/1994 | Wenzel et al. | 175/74 |
| 5,368,111 | A | 11/1994 | Benoit et al. | 175/74 |
| 5,673,765 | A * | 10/1997 | Wattenburg et al. | 175/322 |
| 6,554,083 | B1 | 4/2003 | Kerstetter | 175/61 |

* cited by examiner

*Primary Examiner* — Brad Harcourt
(74) *Attorney, Agent, or Firm* — Charles D. Gunter, Jr.

(57) ABSTRACT

A tilted drive sub is disclosed with a center line of the internal diameter (ID) offset at an angle from the center line of the outer diameter (OD) starting at a point near to a top end of the tilted drive sub. This results in the ID being at an angle to the OD, with the OD of the tilted drive sub remaining straight. The offset ID has the same threads of a mud motor without a tilted drive sub. The tilted drive sub replaces the outer bearing housing of a normal performance mud motor.

7 Claims, 1 Drawing Sheet

TILTED DRIVE SUB

CROSS-REFERENCE TO RELATED APPLICATION

The present application claims priority from Provisional Application Ser. No. 61/082,665, filed Jul. 22, 2008 "Tilted Drive Sub," by the same inventors.

BACKGROUND OF THE INVENTION

1. Field of the Invention

The present invention relates generally to tools used in directional drilling in earth formations and, more specifically, to a drive sub used to change the axial alignment of components of a directional drilling tool.

2. Background of the Invention

In the art of earth drilling there are two standard types of drilling, drilling a straight hole, often a vertical hole, which is commonly referred to as performance drilling. The other type of drilling is called directional drilling, which is when the path of the borehole needs to deviate from straight by some degree. The amount of deviation varies widely and the degree from deviation from straight can be different over the course of the borehole. In the prior art there are three ways which have commonly been used to accomplish directional drilling.

Early directional drilling was accomplished by placing an offset pin in a sub located at the top of the motor. This device was called an "offset top sub." These subs allowed a user to attach and screw standard drill collars into the top of the mud motor and everything from that point up the hole would be on one common axis, which would be offset at some degree "X". "X" could be between 1.5° to 5°, depending on what was called for in a particular drilling situation. However, in actual experience, it was found that with a 3.5° or higher bend machined into this top sub it was difficult to get the tool down hole due to the motor scraping on the sides of the hole. However, a large degree offset top sub was often needed to get any turn or reaction down hole out of the motor due to the fact that the distance between the bit and this machined offset top sub was sometimes in excess of 40 feet.

The next development in directional drilling was the fixed bent housing and/or "bent sub", which had a fixed bend built into the middle of the device. It was found that if an offset top sub was used in conjunction with a fixed bent housing an operator could get the desired degree of offset down hole without having all of the problems of trying to get a 5° offset top sub into the hole. Later, the fixed bent sub with a bend up to 3 degrees would become the standard for modern day directional drilling. On disadvantage of this type of setup, however, was the fact that the operator only had one fixed set bend to work with and, if the direction of drilling was not being changed quickly enough, it was necessary for the operator to pull out of the hole and change mud motors with a fixed bent housing that was machined to a higher degree bend. This is undesirable due to the fact that a drilling operation might have up to four different bent housings screwed onto four different mud motors sitting at a drill site waiting to be used. The need for these extra fixed bent housing mud motors required for directional drilling operations increased the overall cost of the job.

In order to avoid having a plurality of bent subs on site, "adjustable bents subs" were developed in which the magnitude of the bend was adjustable. U.S. Pat. No. 4,077,657 to Trzecia; U.S. Pat. No. 4,813,497 to Wenzel; and U.S. Pat. No. 5,343,966 to Wenzel et al. all disclose various types of adjustable bent housings of the type under consideration. An adjustable bent housing allowed the drill operator to set the motor to whatever degree desired on the rig floor before going into the borehole. The adjustable bent housing had a bend range from 0°, or a straight motor, up to 3° of bend. With this tool, if the operator was behind the curve and consequently not building enough angle to hit the subterranean target, it was possible to pull the mud motor out of the hole, and without changing any parts, reset the degree of bend on the motor to a higher more aggressive bend. However, adjustable bent housings still cause large amounts of friction, and hence wear, on all of the parts below the bend. Both drill bits and certain parts of the mud motors, especially areas below the bent housing, are complex and expensive pieces of machinery. Reducing unnecessary wear on these parts is therefore highly desirable.

As a result, a need has continued to exist for further improvements in directional drilling equipment and methods of operation.

The foregoing examples of the related art and limitations related therewith are intended to be illustrative and not exclusive. Other limitations of the related art will become apparent to those of skill in the art upon a reading of the specification and a study of the drawings.

SUMMARY OF THE INVENTION

It is therefore a primary objective of the present invention to provide a specially designed housing that will allow directional drilling with the least amount of wear and tear on the associated drill bit and associated mud motor parts.

The following embodiments and aspects thereof are described and illustrated in conjunction with systems, tool and methods which are meant to be exemplary and illustrative, and not limiting in scope. In the various embodiments which follow, one or more of the above described problems have been reduced or eliminated, while other embodiments are directed to other improvements.

A tilted drive sub is disclosed with a center line of the internal diameter (ID) offset at an angle from the center line of the outer diameter (OD) starting near the top of the tilted drive sub. This results in the ID being at an angle to the OD, with the OD of the drive sub remaining straight. This offset portion of the ID includes the threads that the remaining mud motor is screwed into. As a result, the mud motor is attached to the tilted drive sub at an angle, with the OD of the tilted drive sub remaining straight with comparison to the rest of the mud motor's OD while the internal components are offset at some predetermined angle. Essentially, the tilted drive sub takes the place of an otherwise ordinary outer bearing housing with no other changes to the original mud motor.

In addition to the exemplary aspects and embodiments described above, further aspects and embodiments will become apparent by reference to the accompanying drawings forming a part of this specification wherein like reference characters designate corresponding parts in the several views.

DETAILED DESCRIPTION OF THE INVENTION

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

The parts which are shown in the following drawings (for example in FIG. 1) toward the left are sometimes referred to as "down hole" or "forward parts" as relating to the drilling direction, which is to the left. The back or trailing end of such parts is to the right.

Figure 1:
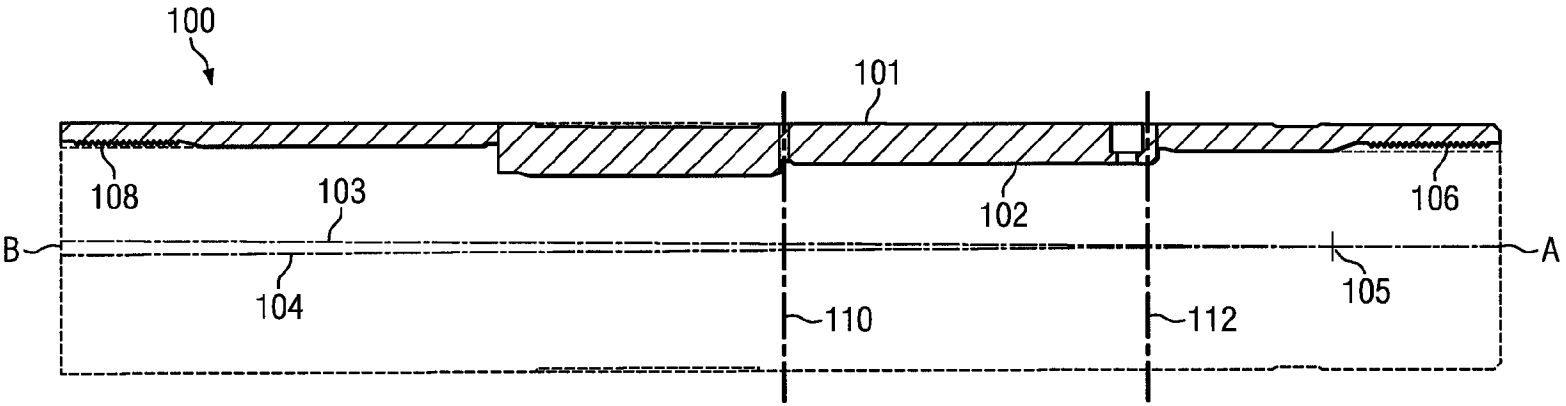
FIG. 1 is a longitudinal, partially cut away, quarter sectional view of the tilted drive sub with the center line of the outer diameter and the inner diameter shown in dotted lines.

Turning now to FIG. 1 of the drawings, a bearing housing 100 has an outer surface 101, an inner bore 102, a top end A and a down hole, or bit end B. The outer surface has an outer diameter, with a center line 104. The inner bore 102 has a center line 103. Starting at point 105 near the back end of the housing 100, the center line 103 of inner bore 102 has a slightly obscure offset in respect to the center line 104 of the outer surface. This offset in the angle introduces an offset to the bit (not shown) when the conventional drill bit is attached to the down hole end B of the mud motor, without a bend in the outer surface 101 of the bearing housing.

In other words, from the point A upwardly (to the right in FIG. 1), the components of the device (including the threaded internal surface 106) will be co-incident with the outer diameter centerline 104. However, because the inner bore center line 103 is offset somewhat, the parts of the device located below the point 105 and below the internally threaded surface 108 will be co-axial or co-incident with the inner diameter centerline 103 and hence offset from this point down.

The point 105, as has been mentioned, is selected to be near the top of the tilted drive sub. By "near the top" is meant that the point is well above the imaginary line 110 which essentially bisects the sub. Preferably, the point 105 is forward of an imaginary line 112 which divides the remaining tool into one of four approximately equal quadrants. The point 105 shown in FIG. 1 is located just below the run out of the threaded surface 106 and approximately divides the quadrant defined between the line 112 and the end "A" in half.

An offset of 0.15 degrees of the inner diameter creates an offset of the bit equal to a 1.5 degree bent flex housing, regardless of whether it is a fixed or adjustable bent housing, which is approximately equivalent to a 5 degree fixed bent top sub. An additional advantage is the fact that the outer diameter of the whole tool is straight, i.e., cylindrical, down to the lower housing. The range of offset can be between zero and to what ever amount of offset is needed for that specific job at hand.

Figure 2:
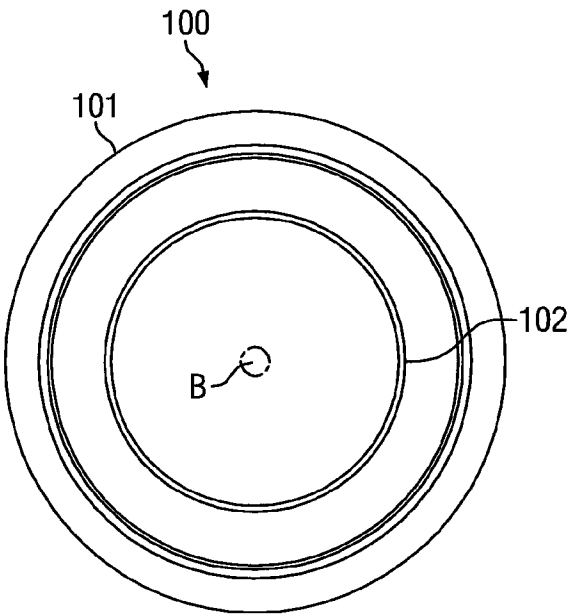
FIG. 2 is a bottom end view of the tilted drive sub, with the off set being exaggerated for ease of viewing.

FIG. 2 is a view taken from the bottom end of the tilted drive sub. In FIG. 2, the offset inner bore 102 is shown exaggerated with respect to the outer surface 101 for ease of viewing.

Figure 3:
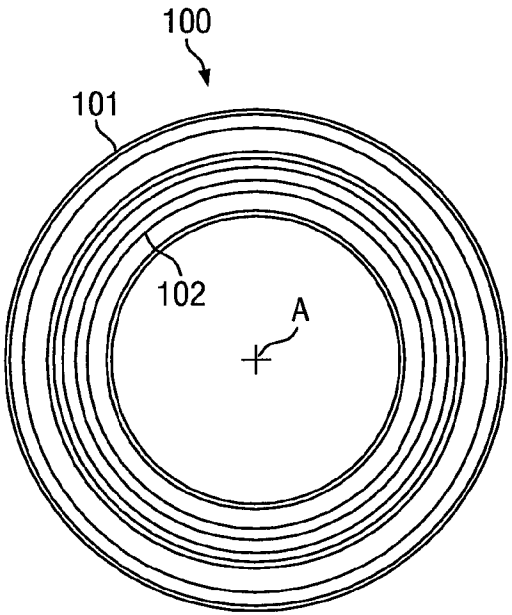
FIG. 3 is a top end view of the tilted drive sub.

As seen in FIG. 3, at the top end A of the bearing housing 100, the inner diameter and the outer diameter, including the internally threaded surface 106, are concentric.

An invention has been provided with several advantages. The significant reduction of outer surface deviation of the design of the invention significantly reduces drag on the sides of the borehole as compared to the prior art. This reduction in hole drag has three advantages. First of all, it is easier to get the tool into and out of the drill hole. Secondly, when steering the direction of the hole, it is possible to maintain a smoother, more uniform hole direction because the motor does not hang up on the side of the hole. Thirdly, it greatly reduces the amount of wear that the outside of the tool receives in the course of the drilling process, which lessens the cost of repair as well as the overall cost of doing business. The improved tilted drive sub of the invention can be used in conjunction with any other directional drilling device of the prior art to change the path of a well bore. For example, the tilted drive sub of the invention can be used with a fixed bent housing, an adjustable bent housing, or an offset top sub, or any other apparatus can be used with the tilted drive sub.

While a number of exemplary aspects and embodiments have been discussed above, those skilled in the relevant drilling arts will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

We claim:

1. A tilted drive sub for a conventional mud motor having a straight outer bearing housing, comprising:

a replacement outer bearing housing, referred to as a tilted drive sub, for a mud motor, the replacement outer bearing housing having a top end and a bottom end, an outer diameter and an internal diameter, with internally threaded surfaces at each of two opposite extents thereof for incorporating the replacement outer bearing housing in the conventional mud motor; and wherein the internal diameter of the replacement outer bearing housing, or tilted drive sub, is on a predetermined center line and the outer diameter of the replacement outer bearing housing is also on a predetermined centerline, and wherein the center line of the internal diameter is offset at an angle from the center line of the outer diameter of the replacement outer bearing housing starting at a point near the top end of the housing, thereby producing a region of the internal diameter of the replacement outer bearing housing which is at an angle to the outer diameter, with the outer diameter of the replacement outer bearing housing remaining straight.

2. The tilted drive sub for a mud motor of claim 1, wherein the center line of the internal diameter of the housing which is offset at some predetermined angle of offset defines an offset region of the housing, and wherein the offset internal diameter region includes an internally threaded surface that attaches additional component parts of the mud motor, whereby the additional component parts of the mud motor are attached to the replacement outer bearing housing tilted drive sub at an angle, with the outer diameter of the replacement outer bearing housing remaining straight in comparison to the remainder of the mud motor outer diameter while any internal components of the housing are offset at a predetermined angle as a result of the tilted drive sub, the offset angle introducing an offset to a conventional bit attached to a downhole end of the mud motor.

3. The tilted drive sub for a mud motor of claim 2, wherein a given offset angle of the internal diameter of the tilted drive sub housing creates a certain offset angle equivalent to that of a bent housing, regardless of whether it is a fixed or adjustable bent housing.

4. The tilted drive sub for a mud motor of claim 2, wherein the internally threaded surface which is located within the offset internal diameter region of the housing has the same threads of a mud motor without a tilted drive sub, making the tilted drive sub housing interchangeable with an outer bearing housing of a conventional mud motor.

5. The tilted drive sub for a mud motor of claim 1, wherein the tilted drive sub is used with a conventional directional drilling sub selected from the group consisting of a fixed bent housing, an adjustable bent housing and an offset top sub.

6. A method of achieving directional drilling with a mud motor, the method comprising the steps of:

providing a replacement for a conventional outer bearing housing with a tilted drive sub housing without the need for any other conventional directional drilling subs mud motor the replacement outer bearing housing having a top end and a bottom end, an outer diameter and an internal diameter, with internally threaded surfaces at each of two opposite extents thereof for incorporating the replacement outer bearing housing in the conventional mud motor; and wherein the internal diameter of the replacement outer bearing housing, or tilted drive sub, is located on a predetermined center line and the outer diameter of the replacement outer bearing housing is also located on a predetermined centerline, and wherein the center line of the internal diameter is offset at an angle from the center line of the outer diameter of the replacement outer bearing housing starting at a point near the top end of the housing, thereby producing a region of the internal diameter of the replacement outer bearing housing which is at an angle to the outer diameter, with the outer diameter of the replacement outer bearing housing remaining straight.

7. The method of claim 6, further comprising the steps of:

connecting additional components of the mud motor to the replacement outer bearing housing, whereby the additional components are attached to the replacement outer bearing housing at an angle, with the outer diameter of the replacement outer bearing housing remaining straight in comparison to the remainder of the mud motor outer diameter while any internal components of the replacement outer bearing housing are offset at a predetermined angle, the offset angle introducing an offset to a conventional bit attached to a downhole end of the mud motor; and operating the mud motor to drill a directional bore hole.

* * * * *